US009149101B2

(12) United States Patent
Richmond et al.

(10) Patent No.: US 9,149,101 B2
(45) Date of Patent: Oct. 6, 2015

(54) HAIR STYLING DEVICE WITH GRIP-TIP

(71) Applicant: TRADE BOX, LLC, Culver City, CA (US)

(72) Inventors: David Richmond, Culver City, CA (US); Howard Richmond, Los Angeles, CA (US); Manuel Montano, Gardena, CA (US)

(73) Assignee: Trade Box, LLC, Culver City, CA (US)

( * ) Notice: Subject to any disclaimer, the term of this patent is extended or adjusted under 35 U.S.C. 154(b) by 0 days.

(21) Appl. No.: 14/481,757

(22) Filed: Sep. 9, 2014

(65) Prior Publication Data

US 2015/0075551 A1 Mar. 19, 2015

Related U.S. Application Data

(60) Provisional application No. 61/878,987, filed on Sep. 17, 2013.

(51) Int. Cl.
*A45D 1/04* (2006.01)
*A45D 2/36* (2006.01)
(Continued)

(52) U.S. Cl.
CPC .. *A45D 1/04* (2013.01); *A45D 7/02* (2013.01); *A45D 2001/002* (2013.01)

(58) Field of Classification Search
CPC ..... A45D 1/04; A45D 1/06; A45D 1/08; A45D 1/18; A45D 2/00; A45D 20/48; A45D 2001/002; A45D 7/00; A45D 7/02; A45D 2/36; A45D 2/367; A45D 4/12; A46B 5/0095; A46B 2200/10; A46B 2200/104
USPC ..... 132/229, 200, 210, 211, 212, 117, 118, 132/119.1, 120, 122, 226–228, 230–239, 132/266, 269, 271, 224, 132, 138, 217, 108, 132/109, 223–225; 219/222, 223, 225–229, 219/238; 34/283, 96; 392/383–385; 15/106; 401/10; D28/12, 13, 14, 15, 35
See application file for complete search history.

(56) References Cited

U.S. PATENT DOCUMENTS 1,377,655 A * 5/1921 Begas ..... 132/229
2,004,760 A 1/1935 Klein
(Continued)

FOREIGN PATENT DOCUMENTS

CN WO2011060569 A1 5/2011
EP 2181618 B1 12/2011
(Continued)

OTHER PUBLICATIONS

Trade Box, LLC, Written Opinion and International Search Report issued in corresponding International Patent Application No. PCT/US2014/054848; ISA/United States Patent and Trademark Office, Dec. 18, 2014.

*Primary Examiner* — Vanitha Elgart
(74) *Attorney, Agent, or Firm* — Laura M. Lloyd; Katherine B. Sales; Leech Tishman Fuscaldo & Lampl

(57) ABSTRACT

A hair styling device comprises a handle, a heatable elongated member having a longitudinal axis, a distal portion and a proximal portion. The proximal portion of the elongated member is connected to the handle. The device has a hair retention slot at the distal portion of the elongated sized to receive and retain a section of a user's hair. Also described is an attachment for a hair styling device providing such a hair retention slot and a method of using the device and the attachment.

17 Claims, 8 Drawing Sheets

(51) Int. Cl.

| | |
|---|---|
| ***A45D 4/00*** | (2006.01) |
| ***A45D 7/02*** | (2006.01) |
| ***A45D 2/08*** | (2006.01) |
| *A45D 1/00* | (2006.01) |

(56) References Cited

U.S. PATENT DOCUMENTS

| | | | | | |
|---|---|---|---|---|---|
| 2,242,913 | A | | 10/1937 | Ingrassia | |
| 2,107,349 | A | | 2/1938 | Solomon | |
| 2,381,195 | A | | 1/1944 | Whittaker | |
| 3,016,059 | A | * | 1/1962 | Hutton | 132/217 |
| 3,128,487 | A | * | 4/1964 | Vallis | 15/176.1 |
| 3,516,420 | A | * | 6/1970 | Porter | 132/263 |
| 3,814,113 | A | * | 6/1974 | Morane et al. | 132/229 |
| 3,955,064 | A | | 5/1976 | Demetrio et al. | |
| 4,192,328 | A | | 3/1980 | Barradas et al. | |
| 4,214,597 | A | * | 7/1980 | Glassman | 132/223 |
| 4,249,550 | A | * | 2/1981 | Cassidy | 132/252 |
| 4,257,434 | A | * | 3/1981 | Wahl | 132/118 |
| 4,368,376 | A | | 1/1983 | Andis | |
| 4,479,047 | A | | 10/1984 | Khaja et al. | |
| 4,549,560 | A | | 10/1985 | Andis | |
| 4,604,514 | A | | 8/1986 | Thaler et al. | |
| 4,743,735 | A | * | 5/1988 | Abura et al. | 219/222 |
| 4,784,165 | A | * | 11/1988 | Stein | 132/217 |
| 4,857,702 | A | | 8/1989 | Cafaro | |
| 4,866,249 | A | * | 9/1989 | Howard | 219/225 |
| 4,982,748 | A | * | 1/1991 | Trimarchi | 132/201 |
| 5,091,630 | A | * | 2/1992 | Djuric | 219/222 |
| 5,119,847 | A | * | 6/1992 | Powell et al. | 132/226 |
| 5,191,907 | A | | 3/1993 | Hirzel | |
| 5,215,107 | A | * | 6/1993 | Van Divner | 132/248 |
| 5,412,828 | A | | 5/1995 | Kuhlmey et al. | |
| 5,460,190 | A | * | 10/1995 | Bondick | 132/247 |
| 5,626,156 | A | * | 5/1997 | Vicory, Sr. | 132/229 |
| 5,671,759 | A | | 9/1997 | Chung et al. | |
| 5,676,480 | A | | 10/1997 | Tosto | |
| 5,837,972 | A | | 11/1998 | Padilla | |
| 6,062,231 | A | * | 5/2000 | De Laforcade | 132/145 |
| 6,067,724 | A | * | 5/2000 | Depoyian | 34/97 |
| 6,070,596 | A | * | 6/2000 | Altamore | 132/224 |
| 6,230,715 | B1 | * | 5/2001 | Cho | 132/217 |
| 6,499,491 | B2 | | 12/2002 | Kennedy et al. | |
| 6,554,000 | B2 | * | 4/2003 | Lin | 132/232 |
| 6,626,599 | B2 | | 9/2003 | De Laforcade | |
| 6,627,852 | B1 | | 9/2003 | Savone | |
| 6,746,165 | B2 | | 6/2004 | De Laforcade | |
| 6,922,909 | B2 | * | 8/2005 | Andrew et al. | 34/96 |
| 7,082,949 | B2 | | 8/2006 | Julemont | |
| 7,481,228 | B2 | | 1/2009 | Ragosta et al. | |
| 8,232,505 | B2 | | 7/2012 | Hottenrot et al. | |
| 8,616,222 | B2 | | 12/2013 | Baker et al. | |
| 2003/0000542 | A1 | * | 1/2003 | Huntley | 132/232 |
| 2005/0076930 | A1 | * | 4/2005 | Yuen et al. | 132/132 |
| 2005/0268933 | A1 | * | 12/2005 | Kimata et al. | 132/238 |
| 2007/0089760 | A1 | | 4/2007 | Evanyk | |
| 2008/0066775 | A1 | | 3/2008 | Mason | |
| 2008/0135537 | A1 | | 6/2008 | Suber et al. | |
| 2008/0173322 | A1 | * | 7/2008 | Leung | 132/232 |
| 2008/0302378 | A1 | | 12/2008 | Rizzieri et al. | |
| 2009/0019653 | A1 | * | 1/2009 | Diamond | 15/106 |
| 2009/0205672 | A1 | | 8/2009 | McDonald | |
| 2010/0300473 | A1 | * | 12/2010 | Kim | 132/217 |
| 2011/0108052 | A1 | * | 5/2011 | Morgandi et al. | 132/230 |
| 2011/0192417 | A1 | * | 8/2011 | Catini | 132/229 |
| 2011/0247646 | A1 | | 10/2011 | Oh | |
| 2011/0284020 | A1 | * | 11/2011 | Tam | 132/211 |
| 2012/0111357 | A1 | | 5/2012 | Amkie | |
| 2012/0240955 | A1 | | 9/2012 | Kennedy et al. | |
| 2013/0199561 | A1 | | 8/2013 | Schlough | |
| 2013/0233336 | A1 | * | 9/2013 | Lazzaro et al. | 132/229 |
| 2014/0053426 | A1 | * | 2/2014 | Ragosta et al. | 34/283 |

FOREIGN PATENT DOCUMENTS

| | | | |
|---|---|---|---|
| FR | EP2392222 | B1 | 9/2013 |
| GB | WO03011069 | A1 | 2/2003 |
| IT | WO2008/075384 | A1 | 6/2008 |
| JP | 2006000412 | A | 1/2006 |
| JP | 201285922 | A | 5/2012 |
| KR | 100994214 | B1 | 11/2010 |

* cited by examiner

HAIR STYLING DEVICE WITH GRIP-TIP

CROSS-REFERENCE TO RELATED APPLICATIONS

This application claims the benefit of U.S. Provisional Patent Application No. 61/878,987 titled "Hair Styling Device With Grip-Tip," filed on Sep. 17, 2013, the contents of which are incorporated herein by reference in their entirety.

BACKGROUND

Many people desire to curl or style their hair. In many heated hair styling devices, a user manually holds their hair with one hand and holds the device with their other hand. Thus the user has both hands utilized and is unable to do anything else. Also a user may need to wear a glove to avoid bums while holding hair against a heated surface.

There are manual and automatic hair styling devices that avoid these problems by providing a built-in arm for clamping hair against a heated surface. This design frees up a user's hand. However, the arm can create undesirable creases in the user's hair. Moreover it cannot be used for retrofitting conventional devices.

Consequently, there is a need for an improved hair styling device with a feature to hold the user's hair in place while the hair is positioned on or in a heated hair styling device without creating creases.

SUMMARY

The present invention overcomes several of the deficiencies, disadvantages and undesired parameters associated with the known hair styling devices. The invention allows the user to hold the user's hair on or against the hair styling device without the use of a clamp or heat gloves, as well as to easily release the hair from the hair styling device after the hair is styled.

The invention is directed to a hair styling device, such as a curling rod, that is able to receive and retain a section of a user's hair on or against the device. In one embodiment, the device comprises a handle and a heated elongated member having a distal portion and a proximal portion. The proximal portion of the elongated member is connected to the handle. The device also comprises a hair retention slot extending through the distal portion of the elongated member or an attachment for the elongated member, the attachment providing the retention slot. The retention slot has a side wall and is sized to receive and retain a section of a user's hair. The side wall preferably is made of elastomeric material such as silicone, and can have bristles extending inwardly from the side wall.

The slot can have a longitudinal axis that can be aligned or not aligned with the longitudinal axis of the elongated member. The slot has a first width at the slot proximal portion, and a second width at the slot distal portion, where the first width can be larger or smaller than the second width.

The invention also provides methods for using the hair styling devices described above. The devices can be used by first activating the heater. A user's hair to be styled is placed into the slot. The user's hair is then wound around the elongated member and heated. Once the desired amount of heat is attained, the user's hair is removed from the elongated member. Alternatively, the user's hair can be first wound around the elongated member and then placed into the slot.

DRAWINGS

These and other features, aspects, and advantages of the present invention will become better understood with regard to the following description, appended claims, and accompanying drawings.

Figures 3A, 3B, 3C, 3D:
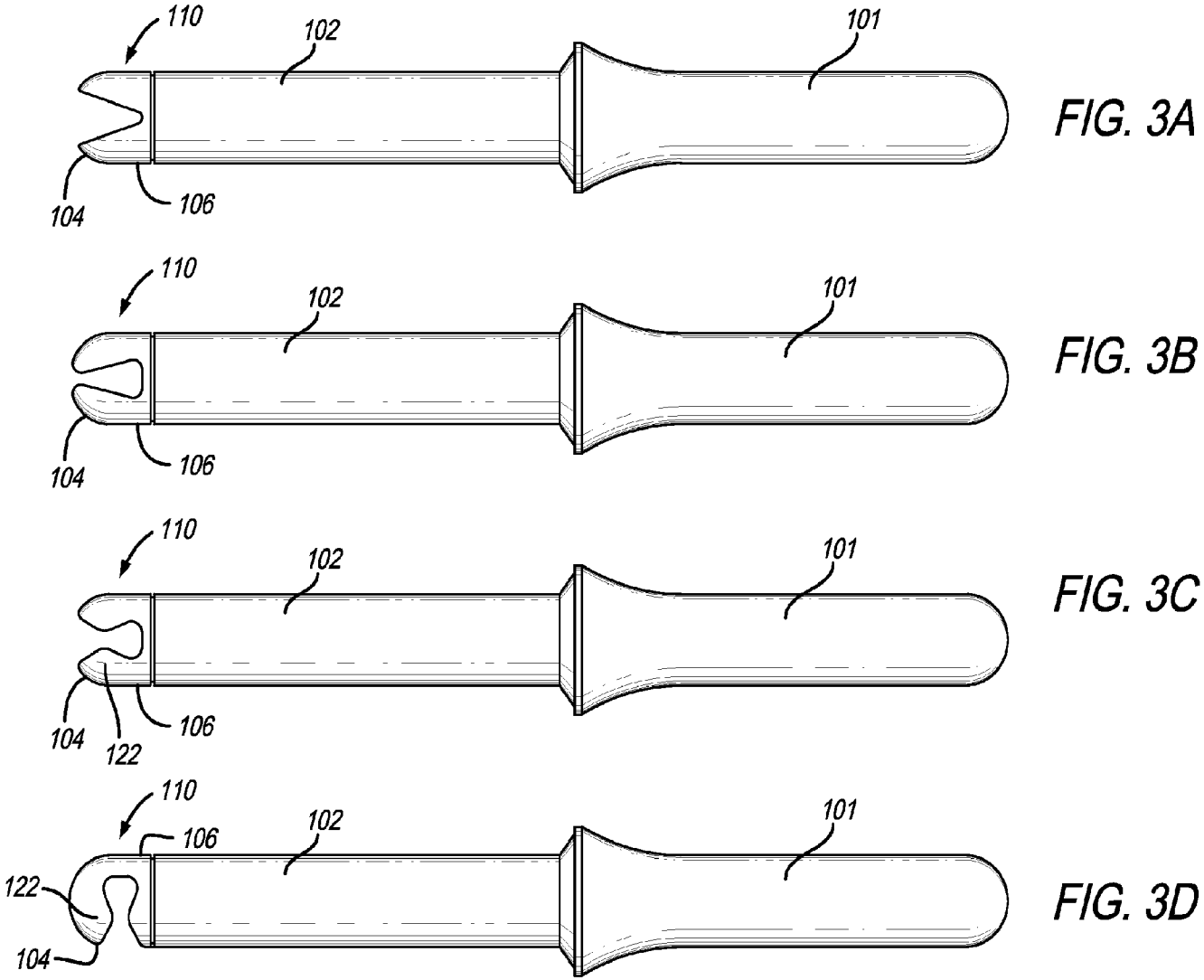

FIGS. 3A, 3B, and 3C are perspective views of alternate slot shapes of the hair styling device.

FIG. 3D shows another version of the device similar to the device of FIG. 3C, wherein the slot is not aligned with the longitudinal axis of the elongated member.

Figure 1:
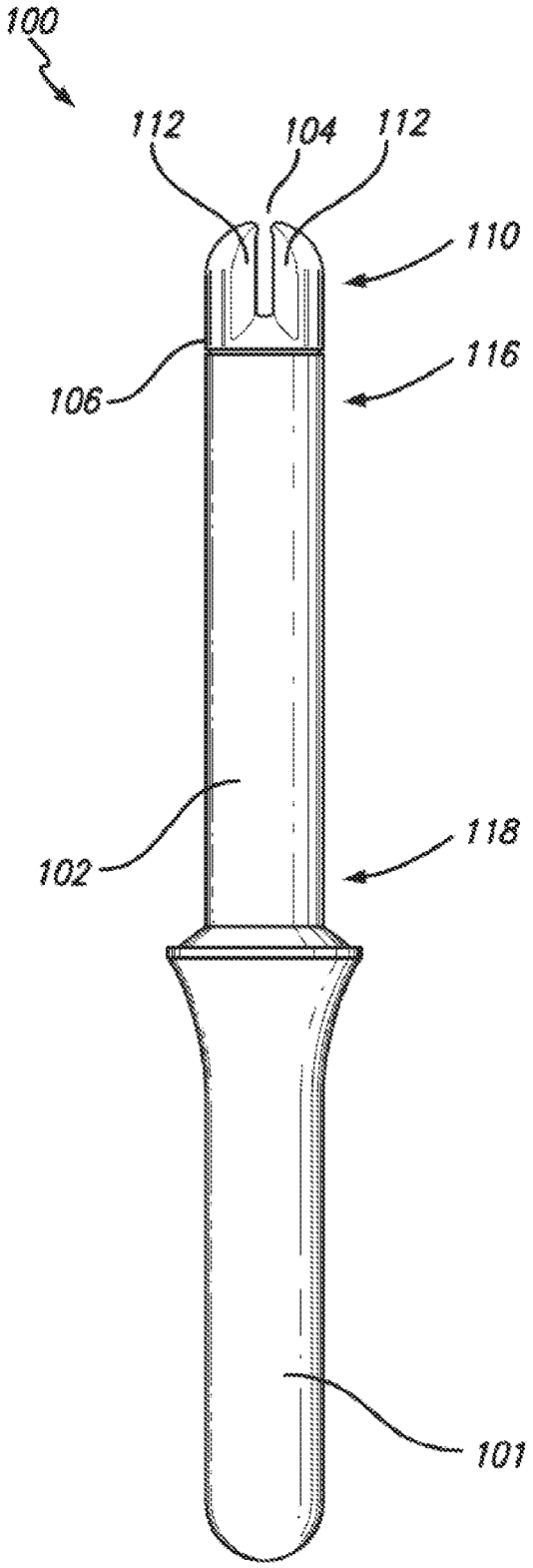
FIG. 1 is a perspective view of a first hair styling device having features of the present invention.
Figure 4:
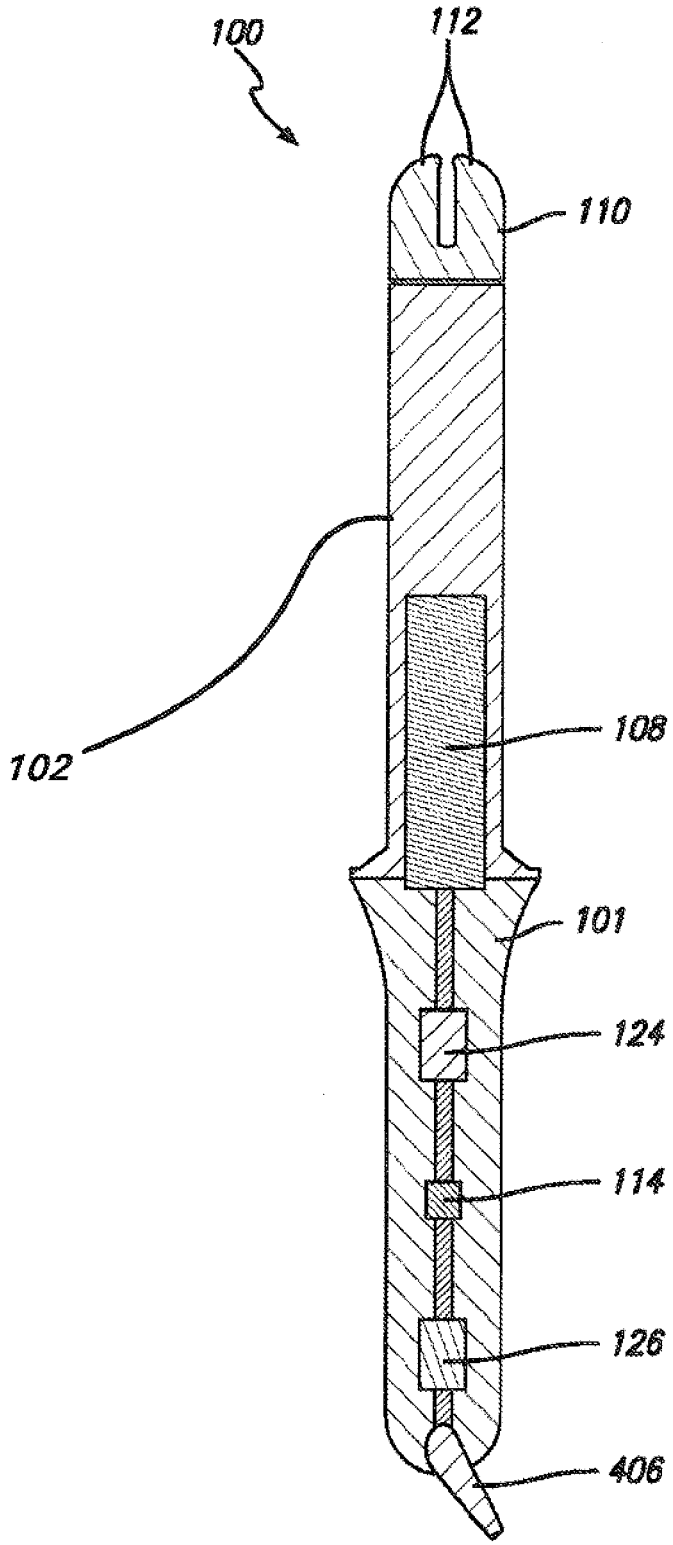

FIG. 4 is a cross-sectional view of the device of FIG. 1.

Figure 5A:
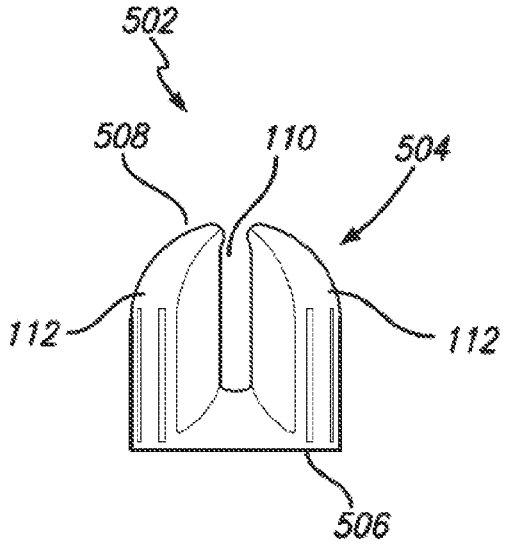

FIG. 5A is a perspective view of an attachment having features of the present invention, the attachment being useful for heated hair styling devices.

Figure 5B:
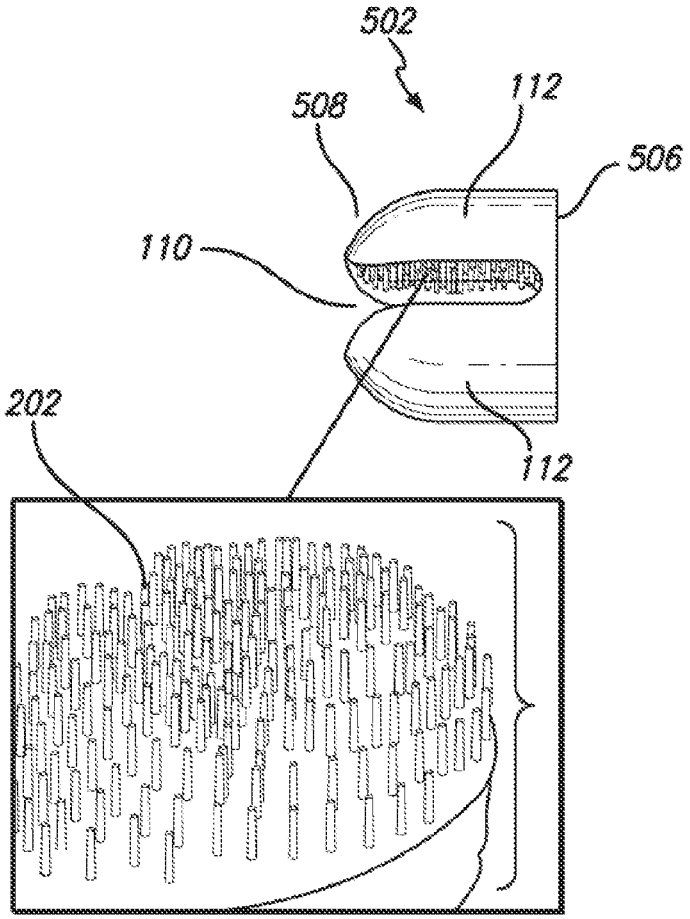

FIG. 5B is an expanded view of a portion of the device of FIG. 5A.

FIGS. 6A, 6B, 6C and 6D are perspective views of a method of using the hair styling device.

Figure 7A:
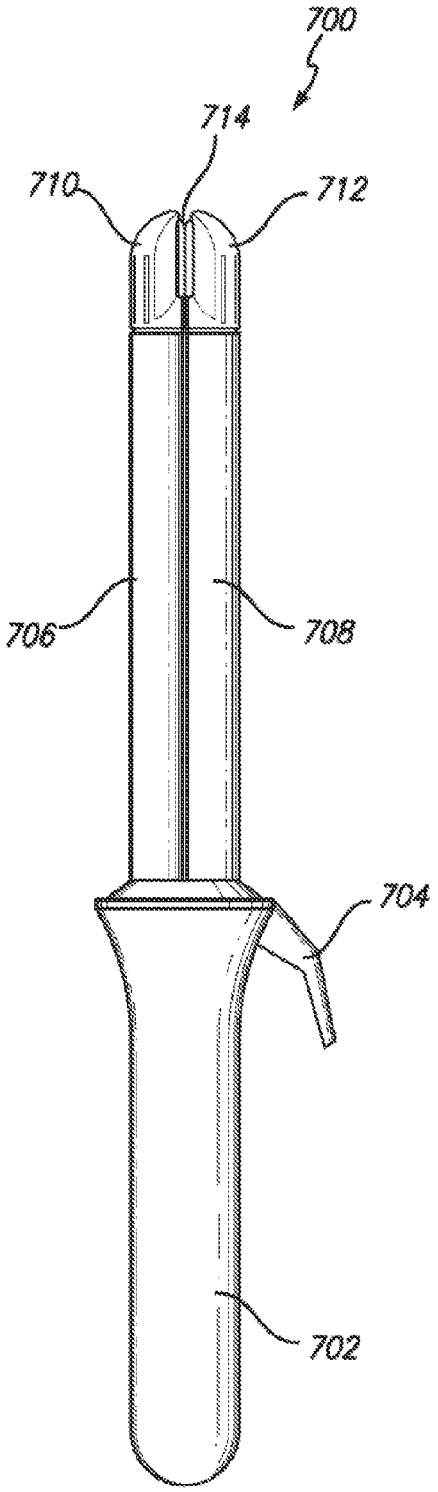
Figure 7B:
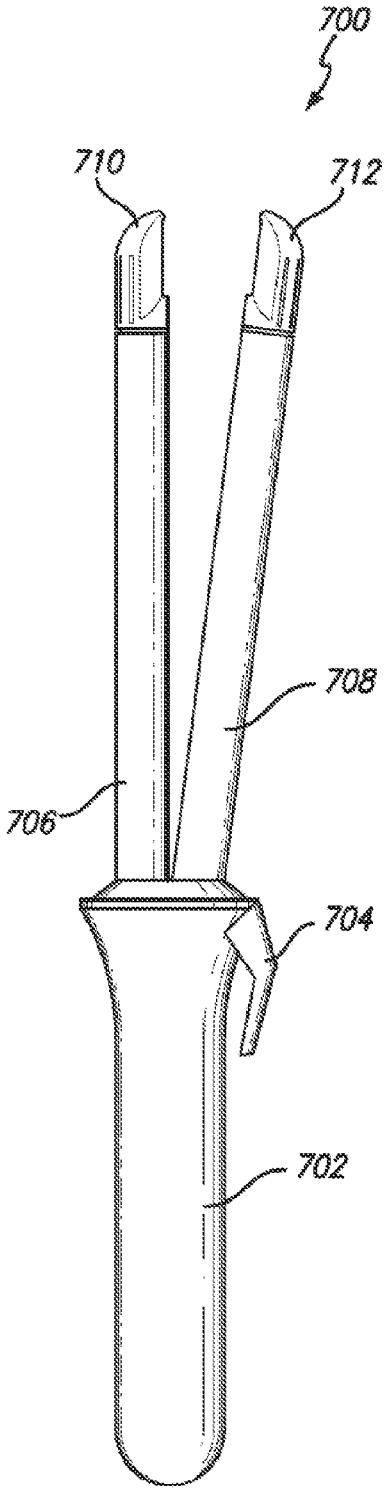

FIGS. 7A and 7B are perspective views of a second version of the hair styling device having features of the present invention, the device being in a closed position and an open position, respectively.

Figure 8:
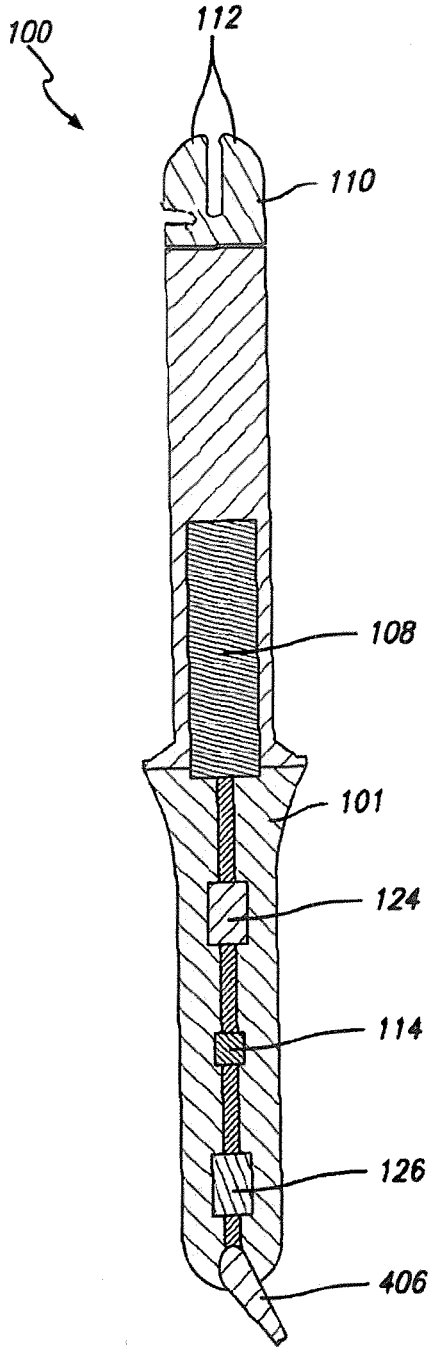

FIG. 8 shows another version of a device according to the invention, which is the same at the device in FIG. 4, except it includes a second slot not aligned with the longitudinal axis of the elongated member.

DESCRIPTION

Definitions

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

The term "elastomeric" means a material that bends under stress, such as pressure, is applied, and returns to its substantially original configuration when the stress is removed.

The term "elongated member" refers to a rod-shaped extension, around which hair can be wrapped.

The term "hair styling device" refers to a tool to style hair. The tool can be a manual or automatic curling iron, flat iron, InStyler®, or the like.

The term "slot" refers to an opening longer than it is wide.

The term "removably" refers to the ability of the user to manually remove an attachment from a hair styling device without the use of tools.

Hair Styling Device With Slot

The invention is directed to a hair styling device 100 that is able to retain a section of the user's hair against a heated portion of the device in order to style the user's hair. The hair styling device can be any device such as a manual or automatic curling iron, flat iron, InStyler®, or the like. One such device 100, as shown in FIGS. 1, 2, 3, 4, 5 and 6 comprises a handle 101, an elongated member 102, and a hair retention slot 110.

As can be seen in FIG. 1, the elongated member 102 has a longitudinal axis, a distal portion 116 and a proximal portion 118. The proximal portion 118 of the elongated member 102 is connected to the handle 101.

The device also has a heater 108 in the handle 101 for heating the elongated member 102, as shown in FIG. 4. The handle 101 can also contain a temperature control 114. This allows the user to select different temperatures depending on hair type and the desired hair style.

The slot 110 is a typically a structure with a side wall 112 typically located at or near the distal portion 116 of the elongated member 102 of the hair styling device 100, and is a way to retain the hair 120 in proximity to the heated portion of the hair styling device 100 without the user having to manually hold the hair 120 in place against the device 100. The slot 110 provides enough lateral tension to prevent the hair 120 from slipping out of the slot 110.

The slot 110 can be positioned anywhere along the elongated member 102. The slot 110 can be located near the handle 101, but preferably the slot 110 is located on or near the distal portion 116 of the elongated member 102. Alternatively, the slot 110 can be at any angle relative to the elongated member 102. Alternatively, the device 100 can have more than one slot 110. The slots 110 can be located anywhere along the elongated member 102, and the slots 110 can also be at any angle relative to the elongated member 102.

Figure 2:
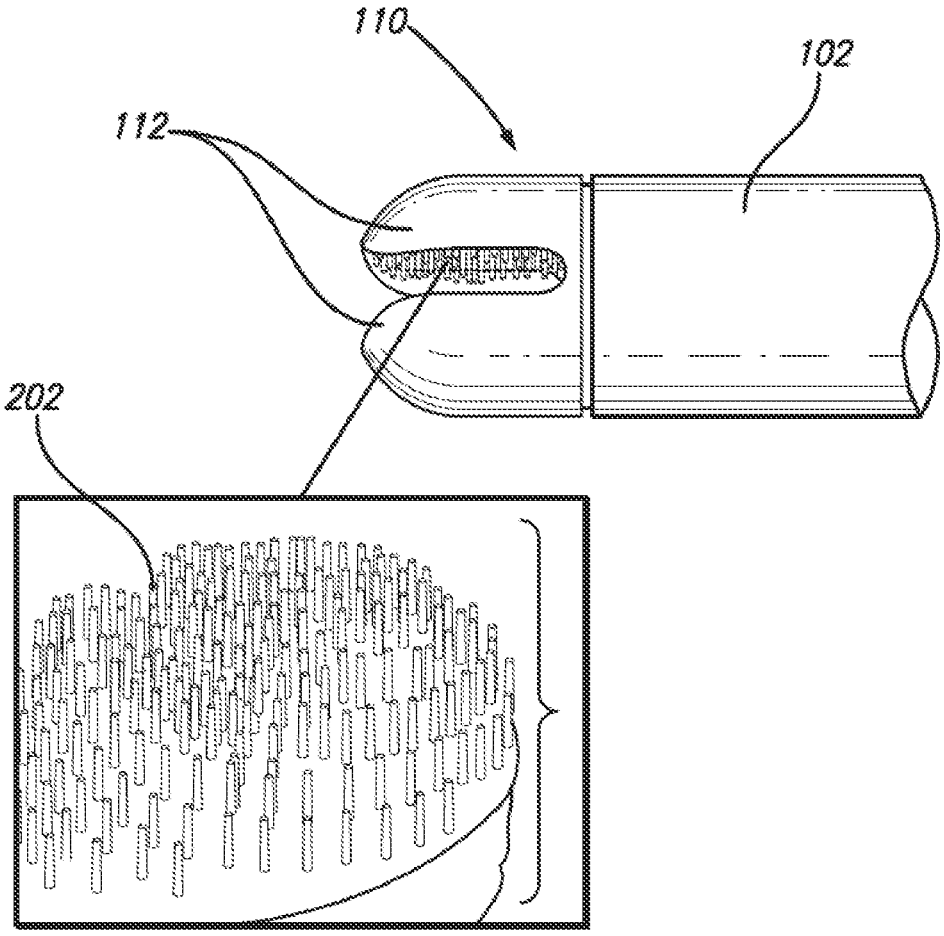
FIG. 2 is an expanded view of a portion of the device of FIG. 1.

The slot 110 is bounded by a side wall 112 and is sized to receive and retain a section of a user's hair 120. As shown in FIGS. 1 through 6, the side wall 112 can be opposed side walls 112. As can be seen in FIG. 2 and FIG. 5B, the side wall 112 can support projections 202 extending into the slot 110. The projections 202 can be any structure that can hold the hair, for example, bristles, protrusions, teeth, pins, or a combination thereof.

The slot 110 can be round, oval, or a parallelogram such as rectangular in horizontal cross-section. Typically the slot 110 can extend into the elongated member 102.

Alternatively, the slot 110 can be a separate device, which can be permanently or removably attached to a hair styling device. Also the shape of the slot 110 in horizontal cross-section can be different in different portions of the slot 110. Thus the slot 110 need not be uniformly shaped.

As can be seen in FIGS. 3A through 3C, the slot 110 has a proximal portion 106 proximate to the elongated member 102 and an opposed distal portion 104. Referring now to FIG. 3A, the distal portion 104 can be wider than the proximal portion 106 to provide a wide opening for ease in placing hair in the slot 110.

Alternatively, referring now to FIG. 3B, the proximal portion 106 can be wider than the distal portion 104 for accommodating a large amount of hair where the narrower distal portion 104 prevents the hair from sliding out of the slot 110.

Alternatively, referring now to FIG. 3C, the slot 110 can be generally hour glass shaped to provide a wide opening at the distal portion 104 for placement of hair in the slot 110, a wide proximal portion 106 to accommodate a large amount of hair, where a narrow mid-section 122, which is narrower than both the proximal portion 106 and the distal portion 104, retains hair in the proximal portion 106 of the slot 110. In contrast, the second width of the slot 110 proximal portion 106 can be larger than the first width of the slot distal portion 104. The slot 110 can be any depth and any width, but typically the slot 110 is between 0.25 inches to 0.5 inches deep, and the slot 110 is from 0.125 inches to 0.25 inches wide.

Preferably the side wall 112 is made of a material that is heat resistant. The heat resistant material can be, for example, an elastomeric material such as foam rubber or silicone.

In one embodiment, the slot 110 has a longitudinal axis that is aligned with the longitudinal axis of the elongated member 102. In another embodiment, the slot 110 has a longitudinal axis that is not aligned with the longitudinal axis of the elongated member 102.

Referring now to FIG. 4, there can be seen a cross-sectional view of the hair styling device 100. The heater 108 can extend up into the elongated member 102. The hair styling device 100 optionally includes a timer 124 and alarm 126 which tracks the amount of time the section of the user's hair 120 remains heated and wound around the elongated member 102, and generates an alarm such as a beep when it is time for the section of the user's hair 120 to be released from the device. The device 100 can also comprise a power cord 406 which allows the device 100 to draw electricity to power itself. Alternatively, the device 100 can also comprise a temperature control 114.

The invention also describes a method for styling a user's hair with the device described above, as shown in FIGS. 6A through 6D. The steps of the method include: (a) activating the heater 108, (b) placing a portion of a section of the user's hair 120 to be styled into the slot 110, (c) winding the section of the user's hair 120 around the elongated member 102, (d) heating the wound section of the user's hair 120 with the heated elongated member 102, and e) removing the section of the user's hair 120 from the elongated member 102. Any portion of the user's hair 120 can be placed in the slot, but generally the portion 120 placed in the slot 110 is the portion of hair near the root of the hair. Alternatively, the portion of hair 120 placed in the slot 110 can be the near the tip of the hair or in the middle of the hair. The steps can be performed in a different order, for example, the section of the user's hair 120 can be wound around the elongated member 102 and then the section of the user's hair 120 can be placed into the slot 110. The heater can be turned on at any time in the process. The slot 110 holds the section of the user's hair 120 against the heated elongated member 102, and produces curls without the user having to manually hold the hair 120 against the elongated member 102 and without forming creases.

Figure 6A:
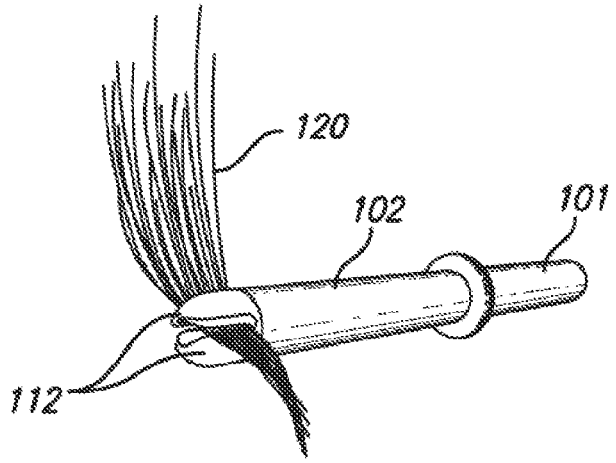
Figure 6B:
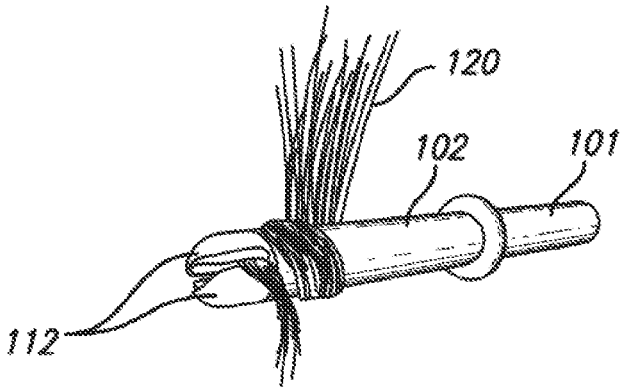
Figure 6C:
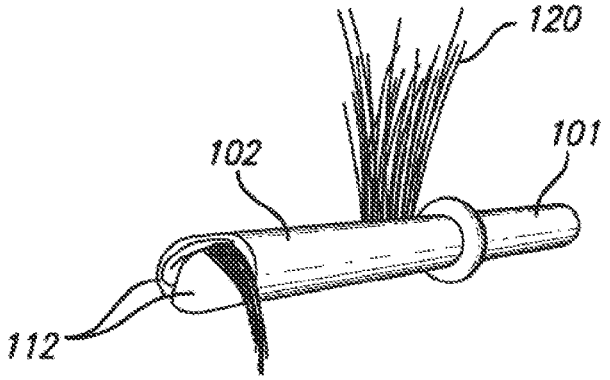
Figure 6D:
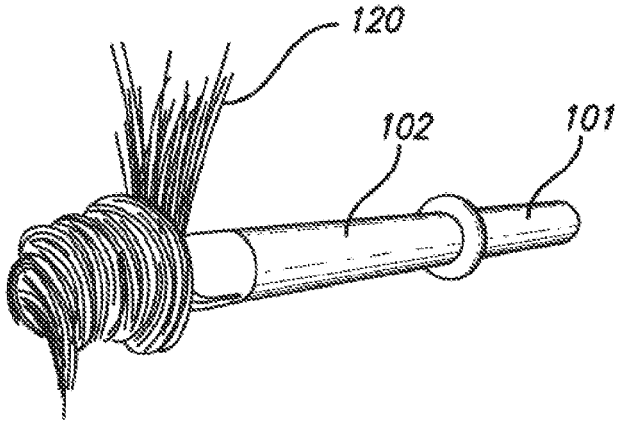

Once the section of the user's hair 120 has been heated for the desired amount of time, the user can pull the device away from their head, allowing the section of the user's hair 120 to be released from the slot 110 and slide off the elongated member 102 without the need for the user to manually unwind or unclamp the section of the user's hair 120 from the device, as shown in FIG. 6D.

Attachment For Use With a Hair Styling Device

Another embodiment of the invention is an attachment 502 for a hair styling device, as shown in FIGS. 5A and 5B. The attachment has a body 504 with a first portion 506 and a second portion 508 opposed to the first portion 506. The first portion 506 has an opening so that it can attach to the hair styling device. The second portion 508 has a slot 110 bordered by a side wall 112. The slot 110 is sized to receive and retain a section of a user's hair 120 during styling. Alternatively, the slot 110 can be placed anywhere on the body 504 of the attachment 502. Alternatively, the attachment 502 can have more than one slot 110, and the slots 110 can be at any angle relative to each other or the hair styling device the attachment 502 is attached to.

In one aspect, the side wall 112 of the body 504 comprises projections 202 such as, for example, bristles as shown in FIG. 5B. The projections 202 aid in retaining the section of the user's hair 120 inside the slot 110.

The attachment 502 can be fitted upon an existing hair styling device such as a hair curler, flat-iron, or rotating iron such as an InStyler® styling device. The attachment can be removably attached to the hair styling device by any means. For example, the first portion 506 of the body 504 can be stretched slightly so as to fit on the end portion of an existing hair styling device, and fitted upon the hair styling device when released so that the attachment remains securely in place. Alternatively, the attachment 502 can be attached to the hair styling device by being slid onto the hair styling device, by being screwed onto the hair styling device or by being locked into position on the hair styling device using a locking mechanism.

In operation, the user fits the first portion 506 of the body 504 over the end portion of a hair styling device. The attachment 502 is then used as described above for the hair styling device with a slot.

The attachment 502 can be made out of any suitable heat-resistant material or combination of materials. For example, the attachment 502 can be made out of silicone, foam rubber such as open cell foam rubber or closed cell foam rubber.

Hair Styling Device With Split Iron And a Slot

A second embodiment, as shown in FIGS. 7A and 7B, comprises a hair styling device 700 with a handle 702 with a release structure 704. The handle 702 is connected to a first elongated member 706 and a second elongated member 708, one or both of which is directly heated. The first and second elongated members 706, 708 have distal portions located opposite a handle 702 and a proximal portion which is located proximate to the handle 702. The first elongated member 706 has a first partial slot 710 at the distal portion of the first elongated member 706. The second elongated member 708 has a second partial slot 712 at the distal portion of the second elongated member 708. The first and second elongated members 706, 708 can be opened to a scissors-like shape, as can be seen in FIG. 7B, by the user by engaging the release structure 704.

When the hair styling device is in the closed position, as can be seen in FIG. 7A, the first elongated member 706 is proximal to the second elongated member 708. Also in the closed position, the first partial slot 710 comes into close proximity with the second partial slot 712, which creates a complete slot 714.

In operation, the hair styling device may be used by first activating the heater 108 to heat the first and second elongated members 706, 708. The user then holds the device and engages the release structure 704. The first and second elongated members 706, 708 open to a scissors-like shape. The user places a section of the user's hair 120 into the opening between the first and second elongated members 706, 708 and releases the release structure 704, allowing the first elongated member 706 to come into close proximity with the second elongated member 708. The user then automatically or manually winds the section of hair 120 around the heated first and second elongated members 706, 708. The user will then place the section of hair 120 in the slot 714 created by the first and second partial slots 710, 712.

Once the section of hair 120 has been heated until a desired style or curl is achieved, the user can engage the release structure 704 and pull the device away from their head, allowing the section of hair 120 to release from the slot 714 without the need to unwind or unclamp the section of hair 120 by hand. This produces the desired curls without the user having to manually hold the section of hair 120 in place on the heated first and second elongated members 706, 708, or manually release the section of hair 120 from the heated member.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended features should not be limited to the description of preferred embodiments contained in this disclosure. All references cited herein are incorporated by reference in their entirety.

What is claimed is:

1. A hair styling device comprising:

a. a handle;

b. an elongated member having a distal portion and a proximal portion, wherein the proximal portion of the elongated member is connected to the handle;

c. a heater supported by the elongated member to heat the elongated member; and d. a hair retainer attached to the distal portion of the elongated member, the hair retainer providing a hair retention slot beyond the distal portion of the heated elongated member, the slot having a proximal portion, a distal portion, and a midsection therebetween, the slot being hour glass shaped, wherein the width of the midsection is less than the width of the proximal portion and the width of the distal portion, the slot being sized to receive and retain a section of a user's hair.

2. A hair styling device comprising:

a. a handle;

b. an elongated member having a longitudinal axis, a distal portion and a proximal portion, wherein the proximal portion of the elongated member is connected to the handle;

c. a heater supported by the elongated member for heating the elongated member; and d. a hair retainer attached to the distal portion of the elongated member, the hair retainer providing a hair retention slot beyond the distal portion of the heated elongated member, wherein the slot has a longitudinal axis not aligned with the longitudinal axis of the elongated member, the slot sized to receive and retain a section of a user's hair.

3. The hair styling device according to claim 2, comprising a wall bordering the slot.

4. The hair styling device according to claim 3, wherein projections extend from the wall into the slot.

5. The hair styling device according to claim 4, wherein the projections comprise bristles.

6. The hair styling device according to claim 3, wherein the wall comprises foam rubber.

7. The hair styling device according to claim 2, wherein the slot has a proximal portion, a distal portion, and a midsection therebetween, the slot being hour glass shaped, wherein the width of the midsection is less than the width of the proximal portion and the width of the distal portion.

8. An attachment for a hair styling device, the attachment comprising a hair retainer, the hair retainer having an opening for attaching to the hair styling device, the hair retainer having a hair retention slot comprising a proximal portion, a distal portion, and a midsection therebetween, the slot being hour glass shaped, wherein the width of the midsection is less than the width of the proximal portion and the width of the distal portion, wherein a wall borders the slot, the slot being sized to receive and retain a section of a user's hair during styling.

9. The attachment according to claim 8, wherein the wall has projections projecting into the slot.

10. The attachment according to claim 9, wherein the projections comprise bristles.

11. The attachment according to claim 8, wherein the wall comprises foam rubber.

12. A method for styling a user's hair with the device of claim 2, comprising the steps of:

a. activating the heater;

b. placing a section of a user's hair to be styled into the slot;

c. winding the section of the user's hair around the elongated member;

d. heating only the wound section of the user's hair with the heated elongated member; and e. after step (d), removing the section of the user's hair from the elongated member.

13. The method of claim 12, wherein step (b) is performed after step (c).

14. The method of claim 12, wherein step (b) is performed before step (a).

15. The hair styling device according to claim 1, wherein the hair retainer is permanently attached to the elongated member.

16. The attachment of claim 8, wherein the attachment is removably attached to a hair styling device, the hair styling device comprising:

a. a handle;

b. an elongated member having a longitudinal axis, a distal portion and a proximal portion, wherein the proximal portion of the elongated member is connected to the handle; and c. a heater supported by the elongated member for heating the elongated member.

17. The hair styling device according to claim 1, wherein the hair retention slot has a longitudinal axis not aligned with the longitudinal axis of the elongated member.

* * * * *